US008592119B2

(12) United States Patent
Wosnick et al.

(10) Patent No.: US 8,592,119 B2
(45) Date of Patent: Nov. 26, 2013

(54) SUPER LOW MELT TONER WITH CORE-SHELL TONER PARTICLES

(75) Inventors: Jordan H. Wosnick, Toronto (CA); Richard P. N. Veregin, Mississauga (CA); Edward G. Zwartz, Mississauga (CA); Michael S. Hawkins, Cambridge (CA)

(73) Assignee: Xerox Corporation, Norwalk, CT (US)

( * ) Notice: Subject to any disclaimer, the term of this patent is extended or adjusted under 35 U.S.C. 154(b) by 3 days.

(21) Appl. No.: 13/413,251

(22) Filed: Mar. 6, 2012

(65) Prior Publication Data

US 2013/0236829 A1 Sep. 12, 2013

(51) Int. Cl.
*G03G 9/00* (2006.01)

(52) U.S. Cl.
USPC ..... 430/109.1; 430/109.3; 430/109.4; 430/110.2; 430/137.14

(58) Field of Classification Search
USPC ..... 430/109.1, 109.3, 109.4, 110.2, 137.14
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 4,295,990 | A | 10/1981 | Verbeek et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 5,236,629 | A | 8/1993 | Mahabadi et al. |
| 5,290,654 | A | 3/1994 | Sacripante et al. |
| 5,302,486 | A | 4/1994 | Patel et al. |
| 5,330,874 | A | 7/1994 | Mahabadi et al. |
| 6,063,827 | A | 5/2000 | Sacripante et al. |
| 6,214,507 | B1 | 4/2001 | Sokol et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,141,761 | B1 | 11/2006 | Dirubio et al. |
| 2006/0222991 | A1 | 10/2006 | Sacripante et al. |
| 2009/0286176 | A1 * | 11/2009 | Ohmura et al. ..... 430/107.1 |
| 2011/0065038 | A1 | 3/2011 | Sacripante et al. |

OTHER PUBLICATIONS

U.S. Appl. No. 12/559,876, filed Sep. 15, 2009.

* cited by examiner

*Primary Examiner* — Thorl Chea
(74) *Attorney, Agent, or Firm* — Oliff & Berridge, PLC

(57) ABSTRACT

A toner particle having a core and a shell, and a method for making the toner particle. The core includes a crystalline resin and the shell includes an amorphous resin. The shell is substantially to completely free of the crystalline resin. The toner particle permits inclusion of greater amounts of crystalline resin materials in the core, thereby lowering the minimum fusing temperature of the toner formed from the particles.

24 Claims, 2 Drawing Sheets

SUPER LOW MELT TONER WITH CORE-SHELL TONER PARTICLES

RELATED APPLICATION

U.S. patent application Ser. No. 12/559,876 filed on Sep. 15, 2009 discloses a toner comprising a core including at least a first amorphous resin, optionally in combination with at least one crystalline resin, an optional colorant, and an optional wax; and a shell over at least a portion of the core including at least a second amorphous resin, wherein the second amorphous resin included in the shell is present in an amount of from about 30 percent to about 40 percent by weight of the toner, and wherein the first amorphous resin and the second amorphous resin may be the same or different.

BACKGROUND

This disclosure is generally directed to toner processes, and more specifically, emulsion aggregation and coalescence processes, as well as toner compositions formed by such processes and development processes using such toners.

Emulsion aggregation/coalescence processes for the preparation of toners are well known.

In a number of electrophotographic engines and processes, toner images may be applied to substrates. The toners may then be fused to the substrate by heating the toner with a contact fuser or a non-contact fuser, wherein the transferred heat melts the toner mixture onto the substrate. Addition of crystalline resin to a toner otherwise containing only amorphous resins leads to sharper toner melting and generally lower fusing temperatures. Therefore, toners containing both amorphous and crystalline resins provide energy-efficient printing by allowing low fuser power consumption in comparison to toners comprising exclusively amorphous resins. According to convention, it was thought that the plasticization effect of the crystalline resin occurs only when the crystalline resin is incorporated into the amorphous resin during fusing.

Toner particles comprising a crystalline resin typically comprise from about 5 to 20% crystalline resin. Further increasing the content of crystalline resin generally provides a correspondingly lower fusing temperature. However, increasing the amount of crystalline resin may result in lower charge maintainability and RH sensitivity. In fact, poor charge maintainability and/or toner charge, especially in humid environments, may be observed in the toner particles comprising more than about 15% crystalline resin because of the low resistivity of the crystalline resin within the toner particles. Thus, decreasing the MFT for toner particles by further increasing the amount of crystalline resin therein may cause the toner particles to exhibit a sharp decrease in charge maintainability and/or toner charge.

Even when a shell made from an amorphous resin is formed around a crystalline resin-containing core, a portion of the crystalline resin may migrate into the shell or to the surface of the toner particles if the crystalline resin content is increased. Additionally, during coalescence of the toner particles, the crystalline component may diffuse or compatibilize with the shell resin. Thus, the toner particles having a core-shell structure may still have a surface that includes crystalline resin. As a result, the low resistivity of the crystalline resin that may be present in the shell or at the surface of the toner particles may cause the toner particles to continue to exhibit poor charge maintainability and/or charge, as detailed above.

Thus, a need exists for methods to incorporate a higher amount of crystalline resin into toner particles while avoiding problems associated with the inclusion of the large amounts of crystalline resin.

SUMMARY

The present disclosure provides a toner particle comprising a shell and a core. The core may comprise a crystalline resin in an amount of from about 10% to about 35% by weight of the toner particle. The shell may be present in an amount from about 45% to about 70% by weight of the toner particle. The present disclosure also provides a method of forming an image using the above toner particles.

EMBODIMENTS

Figure 1:
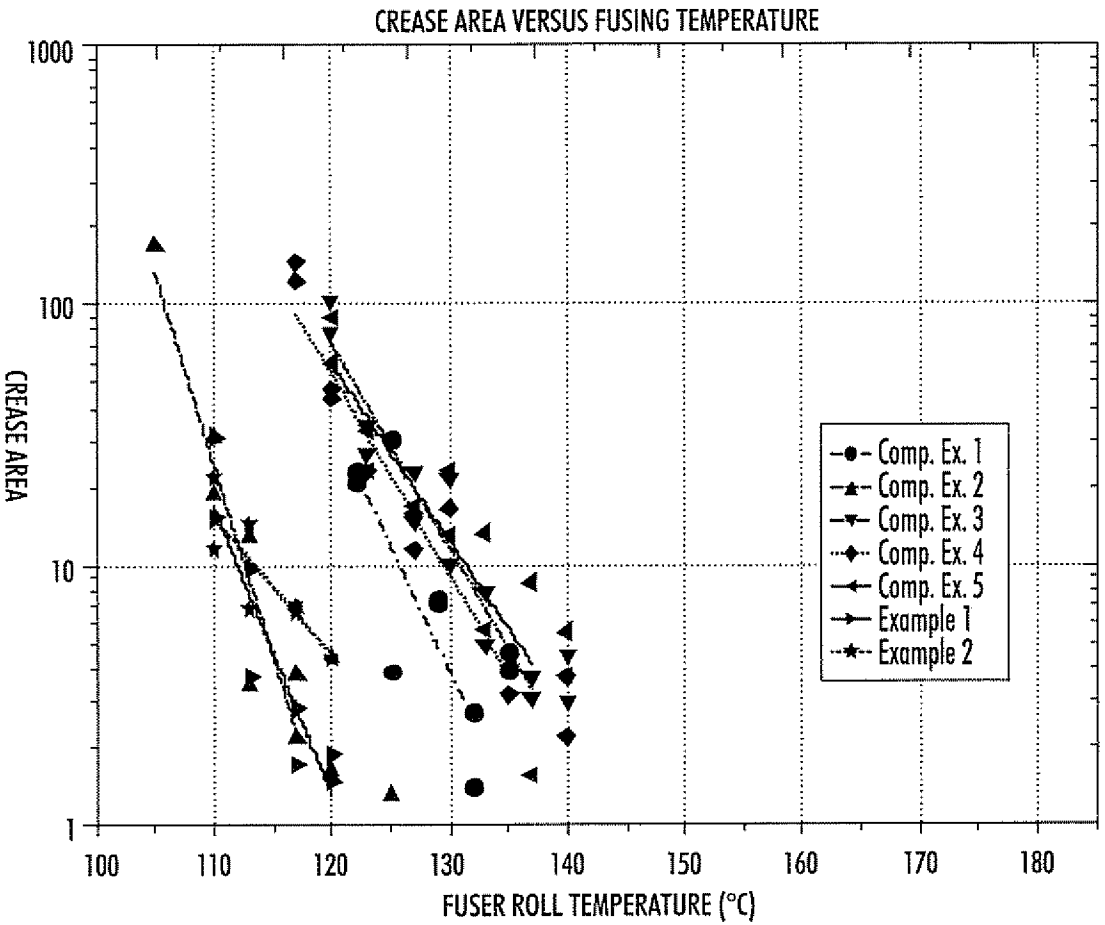
FIG. 1 shows plots of print crease area vs. fusing temperature for the toners described in the Examples.
Figure 2:
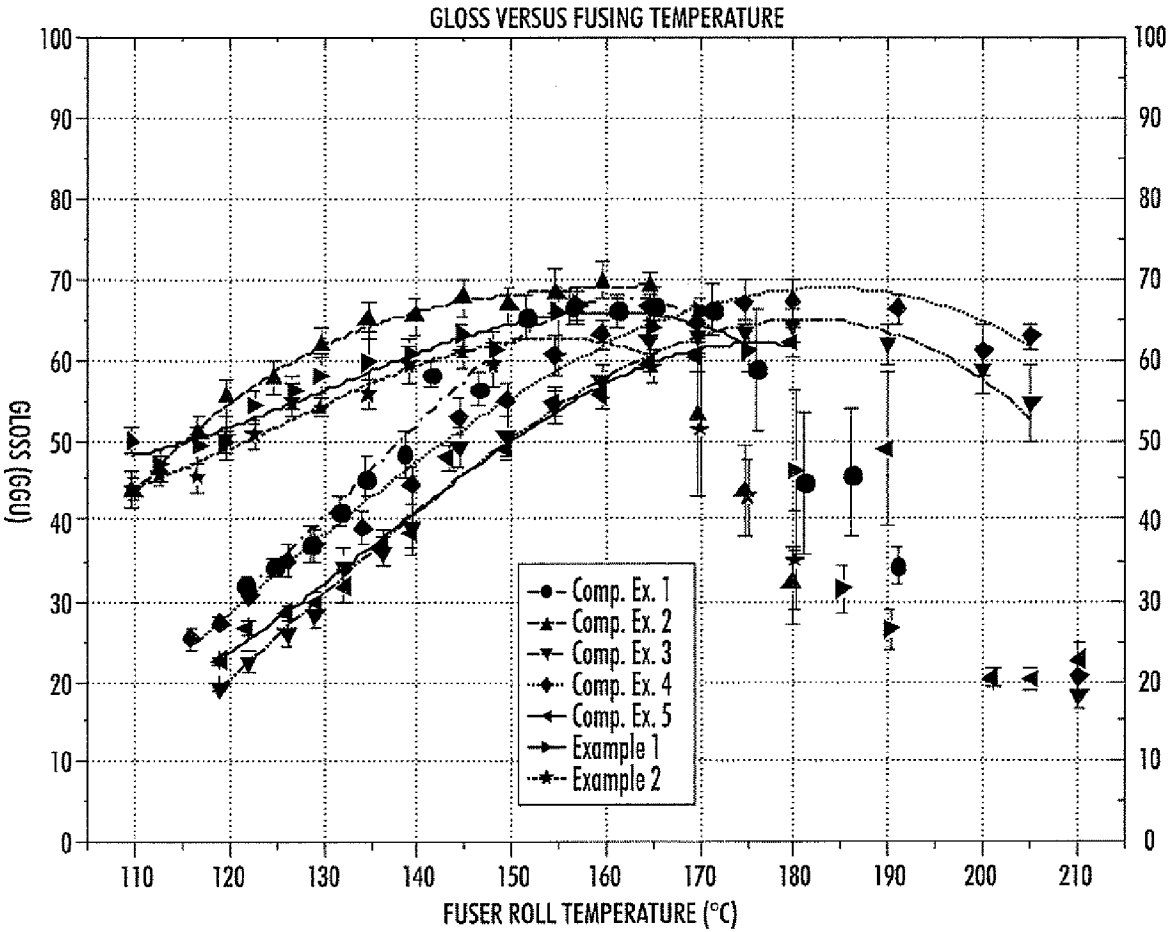
FIG. 2 shows plots of gloss vs. fusing temperature for the toners described in the Examples.

The present disclosure provides a toner particle comprising a core and a shell, wherein the core comprises a crystalline resin and optionally an amorphous resin, and the shell comprises an amorphous resin. The amount of crystalline resin included in the core is increased as compared to a conventional toner to provide a lower fusing temperature than conventional toners. In addition, the shell thickness is increased to keep the increased amount of crystalline resin from reaching the surface of the toner particle. The shell, or at least the outer surface of the shell, of the toner particles may be substantially to completely free of crystalline resin, and may encapsulate the core. In other words, the crystalline resin remains substantially to completely in the core of the toner particle.

The present disclosure also provides a method for making the toner particle, including providing toner particles having a core that comprises crystalline resin and optionally an amorphous resin, and having a shell that comprises amorphous resin, wherein the shell of the particles encapsulates the core of the toner particle and may be substantially to completely free of the crystalline resin. The plasticization effect in the toner particle according to the present disclosure may occur even when the amorphous resin in the shell of the toner particle is completely free from crystalline resin.

Processes of the present disclosure may include aggregating particles, such as particles containing crystalline and amorphous polymeric resins, such as polyesters, optionally a wax, and optionally a colorant, in the presence of a coagulant.

A number of advantages are associated with the toner obtained by the processes and toner compositions illustrated herein. For example, the toner particles of the present disclosure may have a minimum fusing temperature for acceptable crease fix performance of from about 80° C. to about 140° C., or from about 100° C. to about 120° C., or from about 105° C. to about 115° C. Therefore, the minimum fusing temperature may be from about 10° C. to about 30° C. lower than control toners not prepared by the compositions and processes of the present disclosure. In addition, the toner particles of the present disclosure provide xerographic performance, such as charge maintenance, that is comparable to control toners.

Previous core/shell toner particles had limited shell content because of concerns about being able to incorporate the shell into toner without high fines. Also, it was thought that higher loadings of shell would diminish the fusing properties of the toner particle, in part because the crystalline resin would not provide low melt behavior to the extent that it was in the core. However, in embodiments, the toner particles of this disclosure have an increased loading of shell while exhibiting the desired fusing properties, low melt behavior, and charging.

Resin

Toners of the present disclosure may include any resin suitable for use in forming a toner. Such resins, in turn, may be made of any suitable monomer. Suitable monomers useful in forming the resin include, but are not limited to, acrylonitriles, diols, diacids, diamines, diesters, diisocyanates, combinations thereof, and the like. Any monomer employed may be selected depending upon the particular polymer to be utilized.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

One, two, or more resins may be used in forming a toner. In embodiments where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

In embodiments, a suitable toner of the present disclosure may include one or more amorphous polyester resins and a crystalline polyester resin. The weight ratio of the resins may be from about 98% amorphous resins/2% crystalline resin, to about 70% amorphous resins/30% crystalline resin, in embodiments from about 90% amorphous resin/10% crystalline resin, to about 85% amorphous resin/25% crystalline resin.

The resins may be formed by emulsion aggregation methods. Utilizing such methods, the resin may be present in a resin emulsion, which may then be combined with other components and additives to form a toner of the present disclosure.

The resins may be present in an amount of from about 65 to about 95 percent by weight, or from about 70 to about 90 percent by weight, or from about 75 to about 85 percent by weight of the toner particles (that is, toner particles exclusive of external additives) on a solids basis. The ratio of crystalline resin to amorphous resin can be in the range from about 1:99 to about 40:60, such as from about 5:95 to about 35:65, such as from 10:90 to 30:70, such as from about 15:75 to about 30:70, such as from 20:80 to about 25:75, such as from about 25:75 to about 30:70.

Crystalline Resin

The crystalline resin may be a polyester resin formed by reacting a diol with a diacid or diester in the presence of an optional catalyst. For forming a crystalline polyester, suitable organic dials include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, or from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, from about 40 to about 60 mole percent, in embodiments from about 42 to about 55 mole percent, for example from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), polypropylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), poly(nonylene-dodecanoate) copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof.

The amount of crystalline resin included in the core of the toner particle may be from about 10% to about 35% by weight of the toner particle, such as from about 12% to about 30%, or from about 15% to about 25% by weight of the toner particle. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Polycondensation catalysts that may be utilized for the crystalline polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

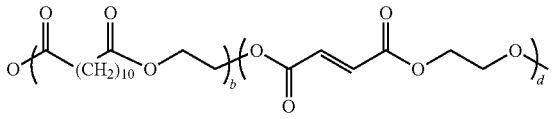

wherein b is from about 5 to about 2000, such as from about 7 to about 1750, in embodiments from about 10 to about 1500; and d is from about 5 to about 2000, such as from about 7 to about 1750, in embodiments from about 10 to about 1500.

In embodiments, a suitable crystalline resin utilized in a toner of the present disclosure may have a weight average molecular weight of from about 10,000 to about 100,000, such as from about 12,000 to about 75,000, in embodiments from about 15,000 to about 30,000.

Amorphous Resin

The amorphous resin may likewise be a polyester resin formed by reacting a diol with a diacid or diester in the presence of an optional catalyst. Suitable catalysts include the above-described polycondensation catalysts.

Examples of diacids or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, acid, dodecenylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic dial selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a resin. Examples of such resins include those disclosed in U.S. Pat. No. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly (butyloxylated bisphenol co-fumarate), poly(co-propoxylated bisphenol co-ethoxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. In embodiments, the amorphous resin utilized in the core may be linear.

In embodiments, a suitable amorphous polyester resin may be a poly(propoxylated bisphenol A co-fumarate) resin having the following formula:

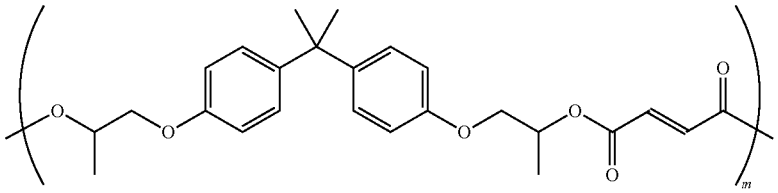

wherein m may be from about 5 to about 1000, such as from about 7 to about 750, in embodiments from about 10 to about 500. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a resin is available under the trade name SPARII from Resana S/A Industrias Quimicas, Sao Paulo, Brazil. Other propoxylated bisphenol A fumarate resins that may be utilized and are commercially available include GTUF and FPESL-2 from Kao Corporation, Japan, XP777 from Reichhold, Research Triangle Park, N.C. and the like.

In embodiments, a suitable amorphous resin utilized in a toner of the present disclosure may have a weight average molecular weight of from about 10,000 to about 100,000, such as from about 12,000 to about 75,000, in embodiments from about 15,000 to about 30,000.

Toner

The resins of the resin emulsions described above, in embodiments an amorphous polyester resin and a crystalline polyester resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants

In embodiments, colorants, waxes, and other additives utilized to than toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210T', IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A 1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI-12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

In addition to the polymer binder resin, the toners of the present disclosure also optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Optionally, a wax may also be combined with the resins in forming toner particles. When included, the wax may be present in an amount of, for example, from about 1 weight percent to about 25 weight percent of the toner particles, or from about 2 weight percent to about 25 weight percent, or from about 5 weight percent to about 20 weight percent of the toner particles.

Waxes that may be selected include waxes having, for example, a weight average molecular weight of from about 500 to about 20,000, such as from about 700 to about 15,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amities, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion (s) including a surfactant, to the emulsion, which may be a mixture of two or more emulsions containing the resins. The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture, although the amounts can be outside of these ranges. This provides a sufficient amount of agent for aggregation.

The gloss of a toner may be influenced by the amount of retained metal ion, such as $Al^{3+}$, in the particle. The amount of retained metal ion may be further adjusted by the addition of materials such as EDTA. In embodiments, the amount of retained crosslinker, for example $Al^{3+}$, in toner particles of the present disclosure may be from about 0.1 pph to about 1 pph, in embodiments from about 0.25 pph to about 0.8 pph, in embodiments about 0.5 pph.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Resin

In embodiments, a shell is applied to the formed aggregated toner particles. Any amorphous resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with the emulsion so that the resin forms a shell over the formed aggregates. In embodiments, an amorphous polyester may be utilized to form a shell over the aggregates to form toner particles having a core-shell configuration. The core may comprise a crystalline resin. The shell may comprise an amorphous resin that is substantially to completely free of crystalline resin.

The shell resin may be thick so as to prevent the increased loading of the crystalline resin from reaching the surface of the toner particle. Thus, the shell resin may be present in an amount of from about 20 percent to about 70 percent by weight of the toner particles, in embodiments from about 30 percent to about 70 percent by weight of the toner particles, such as from about 45 percent to about 70 percent by weight of the toner particles, such as from about 50 percent to about 65 percent by weight of the toner particles, or from about 55 to about 60 percent by weight of the toner particles. By avoiding crystalline resin at the surface of the toner particle, the toner particle may exhibit a resistivity of about at least 1×10" ohm-cm to about $1\times10^{14}$ ohm-cm.

Emulsions of the present disclosure including the resins described above and optional additives may possess particles having a size of from about 100 nm to about 260 nm, in embodiments from about 105 nm to about 155 nm, in some embodiments about 110 nm.

Emulsions including these resins may have a solids loading of from about 10% solids by weight to about 50% solids by weight, in embodiments from about 15% solids by weight to about 40% solids by weight, in embodiments about 35% solids by weight.

Once the desired final size of the toner particles is achieved, the pH of the mixture may be adjusted with a base to a value of from about 6 to about 10, and in embodiments from about 6.2 to about 8. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, a chelating agent may be added to help adjust the pH to the desired values noted above. The base may be added in amounts from about 2 to about 25 percent by weight of the mixture, in embodiments from about 4 to about 10 percent by weight of the mixture. The chelating agent may be, for example, ethylene diamine tetraacetic acid (EDTA), nitrilotriacetic acid (NTA), hydroxyiminosuccinic acid, and the like.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 85° C., in embodiments about 70° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours, although periods of time outside of these ranges can be used.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner, although amounts outside these ranges can be used. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −45 μC/g, in embodiments from about −10 μC/g to about −40 μC/g, and a final toner charging after surface additive blending of from −10 μC/g to about −45 μC/g.

Utilizing the methods of the present disclosure, desirable gloss levels may be obtained. Thus, for example, the gloss level of a toner of the present disclosure may have a gloss as measured by Gardner Gloss Units (ggu) of from about 20 ggu to about 100 ggu, in embodiments from about 50 ggu to about 95 ggu, in embodiments from about 60 ggu to about 90 ggu.

In embodiments, toners of the present disclosure may be utilized as low melt toners. In embodiments, the dry toner particles, exclusive of external surface additives, may have the following characteristics:

(1) Volume average diameter (also referred to as "volume average particle diameter") of from about 2.5 to about 20 microns, in embodiments from about 2.75 to about 10 microns, in other embodiments from about 3 to about 9 microns.

(2) Number Average Geometric Standard Deviation (GSDn) and/or Volume Average Geometric Standard Deviation (GSDv) of from about 1.05 to about 1.55, in embodiments from about 1.1 to about 1.4.

(3) Circularity of from about 0.9 to about 1 (measured with, for example, a Sysmex FPIA 2100 analyzer), in embodiments form about 0.93 to about 0.99, in other embodiments from about 0.95 to about 0.98.

(4) Glass transition temperature of from about 45° C. to about 60° C.

(5) The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It may be desirable in embodiments that the toner particle possess separate crystalline polyester and wax melting points and amorphous polyester glass transition temperature as measured by DSC, and that the melting temperatures and glass transition temperature are not substantially depressed by plasticization of the amorphous or crystalline polyesters, or by any optional wax. To achieve non-plasticization, it may be desirable to carry out the emulsion aggregation at a coalescence temperature of less than the melting point of the crystalline component and wax components.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In embodiments, the fusing of the toner image can be conducted by any conventional means, such as combined heat and pressure fusing such as by the use of heated pressure rollers. In some embodiments, irradiation may also be utilized, for example, in the same fusing housing and/or step where conventional fusing is conducted, or it can be conducted in a separate irradiation fusing mechanism and/or step. In some embodiments, this irradiation step may provide noncontact fusing of the toner, so that conventional pressure fusing may not be required.

For example, in embodiments, the irradiation can be conducted in the same fusing housing and/or step where conventional fusing is conducted. In embodiments, the irradiation fusing can be conducted substantially simultaneously with conventional fusing, such as be locating an irradiation source immediately before or immediately after a heated pressure roll assembly. Desirably, such irradiation is located immediately after the heated pressure roll assembly, such that crosslinking occurs in the already fused image.

In other embodiments, the irradiation can be conducted in a separate fusing housing and/or step from a conventional fusing housing and/or step. For example, the irradiation fusing can be conducted in a separate housing from the conventional such as heated pressure roll fusing. That is, the conventionally fused image can be transported to another development device, or another component within the same development device, to conduct the irradiation fusing. In this manner, the irradiation fusing can be conducted as an optional step, for example to irradiation cure images that require improved high temperature document offset properties, but not to irradiation cure images that do not require such improved high temperature document offset properties. The conventional fusing step thus provides acceptable fixed image properties for moist applications, while the optional irradiation curing can be conducted for images that may be exposed to more rigorous or higher temperature environments.

In other embodiments, the toner image can be fused by irradiation and optional heat, without conventional pressure fusing. This may be referred to, in embodiments, as noncontact fusing. The irradiation fusing can be conducted by any suitable irradiation device, and under suitable parameters, to cause the desired degree of crosslinking of the unsaturated polymer. Suitable non-contact fusing methods are within the purview of those skilled in the art and include, in embodiments, flash fusing, radiant fusing, and/or steam fusing.

In embodiments, non-contact fusing may occur by exposing the toner to infrared light at a wavelength of from about 800 to about 1000, in embodiments from about 800 to about 950, for a period of time of from 5 milliseconds to about 2 seconds, in embodiments from about 50 milliseconds to about 1 second.

Where heat is also applied, the image can be fused by irradiation such as by infrared light, in a heated environment such as from about 100 to about 250° C., such as from about 125 to about 225° C. or from about 150 or about 160 to about 180 or about 190° C.

Exemplary apparatuses for producing these images may include, in embodiments, a heating device possessing heating elements, an optional contact fuser, a non-contact fuser such as a radiant fuser, an optional substrate pre-heater, an image bearing member pre-heater, and a transfuser. Examples of such apparatus include those disclosed in U.S. Pat. No. 7,141,761, the disclosure of which is hereby incorporated by reference in its entirety.

When the irradiation fusing is applied to the toner composition, the resultant fused image is provided with non document offset properties, that is, the image does not exhibit document offset, at temperature up to about 90° C., such as up to about 85° C. or up to about 80° C. The resultant fused image also exhibits improved abrasion resistance and scratch resistance as compared to conventional fused toner images. Such improved abrasion and scratch resistance is beneficial, for example, for use in producing book covers, mailers, and other applications where abrasion and scratches would reduce the visual appearance of the item. Improved resistance to solvents is also provided, which is also beneficial for such uses as mailers, and the like. These properties are particularly helpful, for example, for images that must withstand higher temperature environments, such as automobile manuals that typically are exposed to high temperatures in glove compartments or printed packaging materials that must withstand heat sealing treatments.

It is envisioned that the toners of the present disclosure may be used in any suitable procedure for forming an image with a toner, including in applications other than xerographic applications.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 2° C. to about 30° C.

EXAMPLES

Comparative Example 1

Toner with 6.8% Crystalline Polyester Resin (CPE) and 28% Shell, Coalesced at 85° C.

Linear amorphous polyester latex (105 g), branched amorphous polyester latex (99 g), crystalline aliphatic polyester latex (29 g), deionized water (516 g), Dowfax 2A1 (2.6 g), Pigment Blue 15:3 dispersion (52 g), and 101 Wax D1509 dispersion (46 g) were combined and adjusted to pH 4.2 with dilute $HNO_3$. The mixture was stirred under high-shear mixing from an IKA ULTRA TURRAX homogenizer and a mixture of 2.7 g aluminum sulfate solution (28%) and 72 g water was slowly added at room temperature. The resulting thick mixture was transferred to a heating mantle and stirred at 250-350 rpm while slowly heating to approximately 50° C.

When the average particle size had reached approximately 5.3 μm, a shell mixture consisting of deionized water (56 g), linear amorphous polyester latex (58 g), branched amorphous polyester latex (55 g), and DOWFAX 2A1 (1.3 g) was added. The mixture was heated at 50° C. until a particle size of approximately 5.7 μm had been reached. A solution of 5.8 g DOW VERSENE 100 in 10 ml water was then added and the pH adjusted to 7.8 with dilute NaOH. Stirring was reduced to 180 rpm and the temperature slowly increased to 85° C. After 45 minutes at this temperature, the mixture was acidified by slow portionwise addition of 3M pH 5.7 sodium acetate buffer. When the particles had achieved the desired rounded appearance (by light microscope), heating was discontinued and the mixture was poured onto crushed ice.

The cooled reaction mixture was passed through a metal sieve with a 25-μm pore opening, then filtered and re-suspended in deionized water three times. The washed toner particles were filtered and freeze-dried to yield parent toner particles with average size of 6.0 μm, GSDv 1.20, GSDn 1.25, and mean circularity of 0.975.

Comparative Example 2

Toner with 17% CPE and 28% Shell, Coalesced at 85° C.

The general procedure of Comparative Example 1 was followed, with the amount of all polyester latexes adjusted to provide a toner with a final crystalline polyester content of 17%. The particles had an average size of 6.3 μm, GSDv 1.32, GSDn 1.26, and mean circularity of 0.973.

Comparative Example 3

Toner with 6.8% CPE and 56% Shell, Coalesced at 85° C.

The general procedure of Comparative Example 1 was followed, with the amount of all polyester latexes adjusted to provide a toner with a shell content of 56%. The particles had an average size of 5.4 μm, GSDv 1.23, GSDn 1.26, and mean circularity of 0.958.

Comparative Example 4

Toner with 6.8% CPE and 28% Shell, Coalesced at 70° C.

The general procedure of Comparative Example 1 was followed, with the final coalescence stage taking place at 70° C. rather than 85° C. The particles had an average size of 5.7 μm, GSDv 1.24, GSDn 1.29, and mean circularity of 0.968.

Comparative Example 5

Toner with 6.8% CPE and 56% Shell, Coalesced at 70° C.

The general procedure of Comparative Example 1 was followed, with the amount of all polyester latexes adjusted to provide a toner with a shell content of 56%, and the final coalescence stage taking place at 70° C. rather than 85° C.

The particles had average size (D50) 6.0 μm, GSDv 1.25, GSDn 1.23, and mean circularity (SYSMEX FPIA) 0.955.

Example 1

Toner with 17% CPE and 56% Shell, Coalesced at 70° C.

The general procedure of Comparative Example 1 was followed, with the amount of all polyester latexes adjusted to provide a toner with a crystalline polyester content of 17% and a shell content of 56% and the final coalescence stage taking place at 70° C. rather than 85° C. The particles had an average size of 5.9 μm, GSDv 1.21, GSDn 1.23, and a mean circularity of 0.959.

Example 2

Toner with 17% CPE and 56% Shell, Coalesced at 85° C.

The general procedure of Comparative Example 1 was followed, with the amount of all polyester latexes adjusted to provide a toner with a crystalline polyester content of 17% and a shell content of 56%. The particles had an average size 6.3 μm, GSDv 1.31, GSDn 1.25, and a mean circularity of 0.985.

Fusing Assessment

For this scoping activity the oil-less color fuser in the Patriot fuser (DC250 printer) was used as the test fixture. Unfused images were generated using a modified DC 12 at a 0.50 mg/cm2 and 1.00 mg/cm2 toner mass per unit area onto an uncoated paper, COLOR XPRESSIONS+ (90 gsm) as well as coated paper, DIGITAL COLOR ELITE gloss (120 gsm) before being run through the fuser. Process speed of the fuser was set to 220 mm/s and the fuser roll temperature was varied from gloss offset to where hot offset occurred. Print gloss of the fused prints was then measured using a BYK GARDNER 75o gloss meter. The crease was measured by folding the print and rolling a standard crease tool along the fold. The print was unfolded and the fractured toner was wiped from the print. An image analysis quantifies the amount of toner removed from the print.

Charging Assessment

Additives were blended with the parent toner particles for charging assessment. 30-40 g of parent toner was weighed into the sample holder of the lab scale SK-M10 mill, Additives were weighed into the mill in parts per hundred parts of the parent particle weight. The toner was mixed in the mill for 30 seconds at 13.5 Krpm. After the mixing was complete the toner was sieved through a 45 μm sieve using sonic sieve shaker.

Measurement of Charge with Additives

Developer samples were prepared by weighing 0.5 g of additive toner onto 10 g of Xerox 700 carrier in a washed 60 ml glass bottle. Developer samples were prepared in duplicate as above for each toner being evaluated. One sample of the pair was conditioned in the A-zone environment of 28 C/85% RH, and the other was conditioned in the J-zone environment of 21 C/15% RH. The samples were kept in the respective environments over night to fully equilibrate. The following day the developers were charged by agitating the samples for 60 minutes in a Turbula mixer in their respective zone. The q/d charge on the toner particles was measured using a charge spectrograph. The toner charge was calculated as the midpoint of the toner charge trace from the CSG. Q/d is reported in millimeters of displacement from the zero line. The corresponding Q/m in uC/g was also measured for the sample.

Measurement of Charge Maintenance with Additives

A developer sample was prepared by weighing 0.6 g of additive toner onto 10 g of Xerox 700 carrier in a washed 60 ml glass bottle. The developer was conditioned in an A-zone environment of 28° C./85% RH overnight to equilibrate fully. The following day the developer was charged by agitating the sample for 2 minutes in a Turbula mixer. The charge per unit mass of the sample was measured using a tribo blow-off. The sample was then returned to the A-zone chamber in an idle position. The charge per unit mass measurement was repeated again after 24 hours and 7 days. Charge maintenance was calculated from the 24-hour and 7-day charge as a percentage of the initial charge.

Measurement of Heat Cohesion

About two grams of additive toner was weighed into an open dish and conditioned in an environmental chamber at a specified temperature and 50% relative humidity. After 17 hours the samples were removed and acclimated in ambient conditions for 30 minutes. Each re-acclimated sample was measured by sieving through a stack of two pre-weighed mesh sieves, which were stacked as follows: 1000 μm on top and 106 μm on bottom. The sieves were vibrated for 90 seconds at am amplitude in a Hosokawa flow tester. After the vibration was completed the sieves were reweighed and toner heat cohesion was calculated from the total amount of toner remaining on both sieves as a percentage of the starting weight Measurement of Parent Charge A developer sample was prepared by weighing 0.8 g of parent particles onto 10 g of Xerox 700 carrier in a washed 60 ml glass bottle. Developer samples were prepared in duplicate as above for each toner being evaluated. One sample of the pair was conditioned in the A-zone environment of 28 C/85% RH, and the other was conditioned in the J-zone environment 21 C/15% RH. The samples were kept in the respective environments overnight to fully equilibrate. The following day the developers were charged by agitating the samples for 60 minutes in a Turbula mixer in their respective zone. The following day the developer was charged by agitating the sample for 10 minutes in a Turbula mixer. The q/d charge on the toner particles was measured using a charge spectrograph. Q/m in uC/g was also measured for the sample.

Notable Charging Data

The toners of Examples 1 and 2 showed A- and J-zone charging and RH ratio comparable to commercially available Xerox 700 controls and within the acceptable range. Charge maintenance was significantly improved over the toner of Comparative Example 2 and was comparable to commercially available Xerox 700 controls. In particular, the toner of Example 1 had slightly better charge maintenance than the Xerox 700 design control cyan toner.

Summary of Key Results

Compared to the toner of Comparative Example 1, introducing a thick toner shell and/or lower coalescence temperature in Comparative Examples 3-5: 1) does not have a significant effect on crease fix, gloss mottle, hot offset, or fusing latitude; 2) results in a slight shift in gloss curve to higher temperatures; 3) has a small effect on xerographic charging, with lower 60 minute A-zone Q/d for toner with 56% shell and 70° C. coalescence; and 4) improves charge maintenance.

Compared to the toner of Comparative Example 1, increasing the CPE content to 17% in Comparative Example 2; 1) reduces minimum fusing temperature by approximately 14° C., slightly increases gloss mottle, and slightly decreases hot offset; 2) results in a shift in gloss curve to lower temperatures; 3) does not have a significant effect on fusing latitude; 4) does not have a significant effect on xerographic charging; and reduces charge maintenance.

Compared to the above toner with a CPE content of 17%, as in Comparative Example 2, retaining the 17% CPE and introducing a thick toner shell as in Examples 1-2: 1) slightly reduces minimum fusing temperature (at 85° C. coalescence) and peak gloss; does not have a significant effect on cold offset, gloss mottle, or hot offset; improves xerographic charging, especially parent charge; and improves charge maintenance.

Fusing performance of toners with CPE content of 17% and a thick toner shell, as in Examples 1-2, is limited by cold offset rather than crease fix, and yields an effective minimum fusing temperature of about 40° C. lower than the Comparative Examples.

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner particle comprising a shell and a core, wherein
the core comprises a crystalline resin in an amount from about 10% to about 35% by weight of the toner particle,
the shell comprises an amorphous resin that completely encapsulates the core,
the shell is substantially free of the crystalline resin, and
the shell is present in an amount from about 45% to about 70% by weight of the toner particle.

2. The toner particle of claim 1, wherein the shell is present in an amount from about 50% to about 65% by weight of the toner particle.

3. The toner particle of claim 1, wherein the crystalline resin is present in an amount from about 15% to about 35% by weight of the toner particle.

4. The toner particle of claim 1, wherein the shell is completely free of the crystalline resin.

5. The toner particle of claim 1, wherein the shell is present in an amount from about 45% to about 70% by weight of the toner particle, and the crystalline resin is present in an amount from about 15% to about 35% by weight of the toner particle.

6. The toner particle of claim 1, further comprising at least one of a colorant, a wax, a curing agent, a charge additive, and a surface additive.

7. The toner particle of claim 1, wherein the toner particle is an emulsion/aggregation toner particle.

8. The toner particle of claim 1, wherein the toner particle has a minimum fusing temperature of from about 80° C. to about 140° C.

9. The toner particle of claim 1, wherein the toner particle exhibits a resistivity of about $1 \times 10^{11}$ ohm-cm to about $1 \times 10^{14}$ ohm-cm.

10. The toner particle of claim 1, wherein the core only includes components selected from the group consisting of the crystalline resin, a wax, a colorant, and an aggregating agent.

11. The toner particle of claim 10, wherein the toner particle has a volume average particle diameter from 3 to 5.9μm.

12. A method for forming an image comprising:
forming an electrostatic latent image on a surface of a latent image carrying member;
developing the electrostatic latent image formed on the surface of the latent image carrying member with a developer comprising a toner to form a toner image;
transferring the toner image formed on the surface of the latent image carrying member to a surface of a transfer material; and
fusing the toner image transferred to the surface of the transfer material by heating, wherein
the toner comprises a toner particle having a shell and a core, wherein
the core comprises a crystalline resin in an amount from about 10% to about 35% by weight of the toner particle,
the shell comprises an amorphous resin that completely encapsulates the core,
the shell is substantially free of the crystalline resin, and
the shell is present in an amount from about 45% to about 70% by weight of the toner particle.

13. The method of claim 12, wherein the shell of the toner particle is present in an amount from about 50% to about 65% by weight of the toner particle.

14. The method of claim 12, wherein the crystalline resin of the toner particle is present in an amount from about 15% to about 35% by weight of the toner particle.

15. The method of claim 12, wherein the shell of the toner particle is completely free of the crystalline resin.

16. The method of claim 12, wherein the shell is present in an amount from about 45% to about 70% by weight of the toner particle, and the crystalline resin is present in an amount from about 15% to about 35% by weight of the toner particle.

17. The method of claim 12, wherein the toner particle exhibits a resistivity from about $1 \times 10^{11}$ ohm-cm to about $1 \times 10^{14}$ ohm-cm.

18. The method of claim 12, wherein the toner particle has a minimum fusing temperature of from about 80° C. to about 140° C.

19. The method of claim 12, wherein the core only includes components selected from the group consisting of the crystalline resin, a wax, a colorant, and an aggregating agent.

20. The method of claim 19, wherein the toner particle has a volume average particle diameter from 3 to 5.9 μm.

21. A method of forming a toner particle, the method comprising
providing a core comprising a crystalline resin in an amount from about 10% to about 35% by weight of the toner particle, and
providing a shell comprising an amorphous resin that completely encapsulates the core, wherein
the shell is substantially free of the crystalline resin, and
the shell is present in an amount from about 45% to about 70% by weight of the toner particle.

22. The method of claim 21, wherein the toner particle is fused by an emulsion aggregation method.

23. The method of claim 21, wherein the core only includes components selected from the group consisting of the crystalline resin, a wax, a colorant, and an aggregating agent.

24. The method of claim 23, wherein the toner particle has a volume average particle diameter from 3 to 5.9 μm.

* * * * *